US010442652B2

(12) United States Patent
Mashimo et al.

(10) Patent No.: US 10,442,652 B2
(45) **Date of Patent: *Oct. 15, 2019**

(54) SHEET CONVEYANCE DEVICE CAPABLE OF DETECTING SHAPE OF SHEET, IMAGE FORMING APPARATUS, SHEET SHAPE DETECTING METHOD

(71) Applicant: KYOCERA Document Solutions Inc., Osaka-shi, Osaka (JP)

(72) Inventors: Takayuki Mashimo, Osaka (JP); Toshiaki Mutsuo, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/979,103

(22) Filed: May 14, 2018

(65) Prior Publication Data

US 2018/0334348 A1 Nov. 22, 2018

(30) Foreign Application Priority Data

May 22, 2017 (JP) ..... 2017-100508

(51) Int. Cl.
*B65H 29/20* (2006.01)
*B65H 43/02* (2006.01)
(Continued)

(52) U.S. Cl.
CPC ..... *B65H 29/20* (2013.01); *B65H 7/14* (2013.01); *B65H 7/20* (2013.01); *B65H 43/02* (2013.01); *B65H 2511/512* (2013.01); *B65H 2513/10* (2013.01); *B65H 2513/20* (2013.01); *B65H 2513/50* (2013.01); *B65H 2553/40* (2013.01);
(Continued)

(58) Field of Classification Search
CPC .. B65H 9/006; B65H 11/005; B65H 2513/10; B65H 2513/108; B65H 2553/412; B65H 2553/416; B65H 2553/822; B65H 2553/1111; B65H 2701/113
See application file for complete search history.

(56) References Cited

U.S. PATENT DOCUMENTS 8,382,241 B2 2/2013 Saitoh et al.
8,864,271 B2 10/2014 Abe
(Continued)

FOREIGN PATENT DOCUMENTS

JP 2012111152 A 6/2012

*Primary Examiner* — Jeremy R Severson
(74) *Attorney, Agent, or Firm* — Alleman Hall Creasman & Tuttle LLP

(57) ABSTRACT

A sheet conveyance device includes a shape detecting portion, and a switch control portion. The shape detecting portion detects a shape of a sheet at a detection position located between a first conveyance member and an image forming position in a sheet conveyance path. The switch control portion, when the first conveyance member is determined to be in an accelerated state where it is accelerated from a stopped state to a driven state, switches an detection interval at which the shape of the sheet is detected by the shape detecting portion, to a first interval that corresponds to a rotation speed of the first conveyance member, and when the first conveyance member is determined to be in a decelerated state where it is decelerated from the driven state to the stopped state, switches the detection interval to a predetermined second interval.

12 Claims, 4 Drawing Sheets

(51) Int. Cl.
*B65H 7/14* (2006.01)
*B65H 7/20* (2006.01)

(52) U.S. Cl.
CPC . *B65H 2553/414* (2013.01); *B65H 2701/1111* (2013.01); *B65H 2801/15* (2013.01)

(56) References Cited

U.S. PATENT DOCUMENTS

| | | | | |
|---|---|---|---|---|
| 9,944,480 | B2 * | 4/2018 | Hirano | B65H 7/12 |
| 10,160,205 | B2 * | 12/2018 | Tanaka | B41J 2/165 |
| 10,273,103 | B2 * | 4/2019 | Mashimo | B41J 11/008 |
| 2007/0236528 | A1 | 10/2007 | Oike | |
| 2012/0256365 | A1 * | 10/2012 | Yamagata | B65H 9/006 271/10.11 |
| 2014/0239584 | A1 * | 8/2014 | Hori | B65H 7/125 271/265.04 |
| 2018/0236768 | A1 * | 8/2018 | Tanaka | B41J 2/165 |
| 2018/0334345 | A1 * | 11/2018 | Mashimo | B41J 11/008 |

* cited by examiner

SHEET CONVEYANCE DEVICE CAPABLE OF DETECTING SHAPE OF SHEET, IMAGE FORMING APPARATUS, SHEET SHAPE DETECTING METHOD

INCORPORATION BY REFERENCE

This application is based upon and claims the benefit of priority from the corresponding Japanese Patent Application No. 2017-100508 filed on May 22, 2017, the entire contents of which are incorporated herein by reference.

BACKGROUND

The present disclosure relates to a sheet conveyance device, an image forming apparatus including a sheet conveyance device, and a sheet shape detecting method executed on a sheet conveyance device.

An image forming apparatus such as a printer includes a registration roller. Each time a predetermined conveyance timing comes, the registration roller feeds a sheet toward a conveyance belt that conveys the sheet at an image forming position where an image is formed by an image forming portion.

In addition, there is known a configuration that includes a shape detecting portion configured to detect a shape of a sheet at a position immediately before the image forming position in a sheet conveyance path, in order to prevent developer such as ink from adhering to the conveyance belt at the image forming position. For example, there is known a configuration that includes a shape detecting portion including an image sensor disposed immediately before the image forming position in the conveyance path.

SUMMARY

A sheet conveyance device according to an aspect of the present disclosure includes a first conveyance member, a shape detecting portion, a speed detecting portion, a determination processing portion, and a switch control portion. The first conveyance member is provided on an upstream side of an image forming position in a conveyance path along which a sheet is conveyed. The first conveyance member is rotationally driven in a driving cycle in which the first conveyance member enters a driven state where the first conveyance member is driven while decelerated in a stepped manner, and then the first conveyance member is decelerated to a stopped state. The shape detecting portion includes a light emitting portion and a light receiving portion. The light emitting portion emits light toward a detection position located between the first conveyance member and the image forming position in the conveyance path, the light extending in a width direction of the sheet perpendicular to the conveyance path. The light receiving portion receives the light that has been emitted from the light emitting portion and reflected on the sheet passing the detection position, and output a detection signal corresponding to an amount of received light. The shape detecting portion detects a shape of the sheet based on the detection signal. The speed detecting portion detects a rotation speed of the first conveyance member. The determination processing portion determines whether the first conveyance member is in an accelerated state or in a decelerated state, wherein in the accelerated state, the first conveyance member is accelerated from the stopped state to the driven state, and in the decelerated state, the first conveyance member is decelerated from the driven state to the stopped state. The switch control portion, when the determination processing portion determines that the first conveyance member is in the accelerated state, switches an output interval at which the detection signal is output from the light receiving portion, to a first interval that corresponds to the rotation speed detected by the speed detecting portion, and when the determination processing portion determines that the first conveyance member is in the decelerated state, switches the output interval to a predetermined second interval.

An image forming apparatus according to another aspect of the present disclosure includes the sheet conveyance device and an image forming portion. The image forming portion forms an image on a sheet at the image forming position.

A sheet shape detecting method according to a further aspect of the present disclosure is executed on a sheet conveyance device which includes a first conveyance member, a shape detecting portion, and a speed detecting portion, the first conveyance member being provided on an upstream side of an image forming position included in a conveyance path along which a sheet is conveyed, the first conveyance member being rotationally driven in a driving cycle in which the first conveyance member enters a driven state where the first conveyance member is driven while decelerated in a stepped manner, and then the first conveyance member is decelerated to a stopped state, the shape detecting portion including a light emitting portion and a light receiving portion, the light emitting portion being configured to emit light toward a detection position located between the first conveyance member and the image forming position in the conveyance path, the light extending in a width direction of the sheet perpendicular to the conveyance path, the light receiving portion being configured to receive light that has been emitted from the light emitting portion and reflected on the sheet passing the detection position, and output a detection signal corresponding to an amount of received light, the shape detecting portion detecting a shape of the sheet based on the detection signal, the speed detecting portion being configured to detect a rotation speed of the first conveyance member. The sheet shape detecting method includes: determining whether the first conveyance member is in an accelerated state or in a decelerated state, wherein in the accelerated state, the first conveyance member is accelerated from the stopped state to the driven state, and in the decelerated state, the first conveyance member is decelerated from the driven state to the stopped state; and when it is determined that the first conveyance member is in the accelerated state, switching an output interval at which the detection signal is output from the light receiving portion, to a first interval that corresponds to the rotation speed detected by the speed detecting portion, and when it is determined that the first conveyance member is in the decelerated state, switching the output interval to a predetermined second interval.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings for the understanding of the present disclosure. It should be noted that the following embodiment is an example of a specific embodiment of the present disclosure and should not limit the technical scope of the present disclosure.

[Outlined Configuration of Image Forming Apparatus 10]

Figure 1:
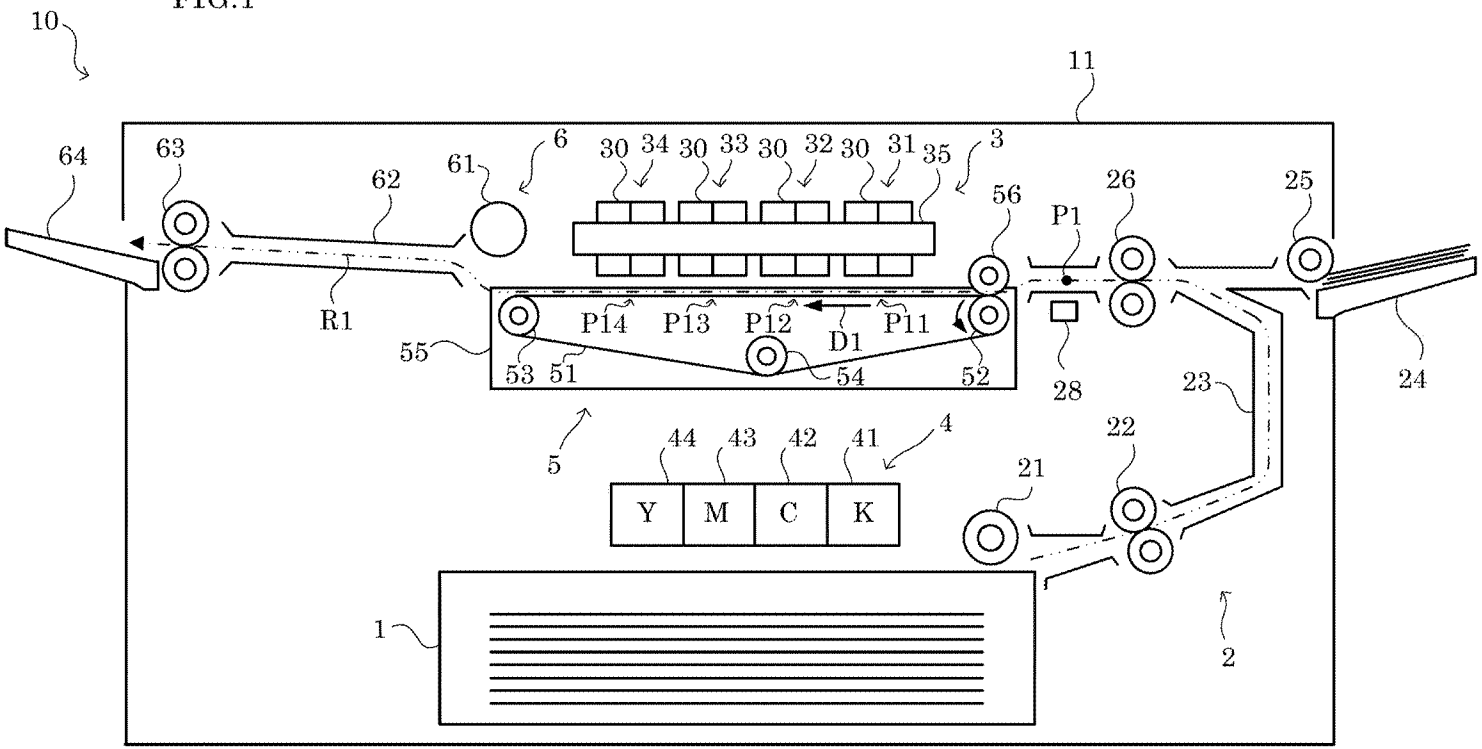
FIG. 1 is a diagram showing a configuration of an image forming apparatus according to an embodiment of the present disclosure.
Figure 2:
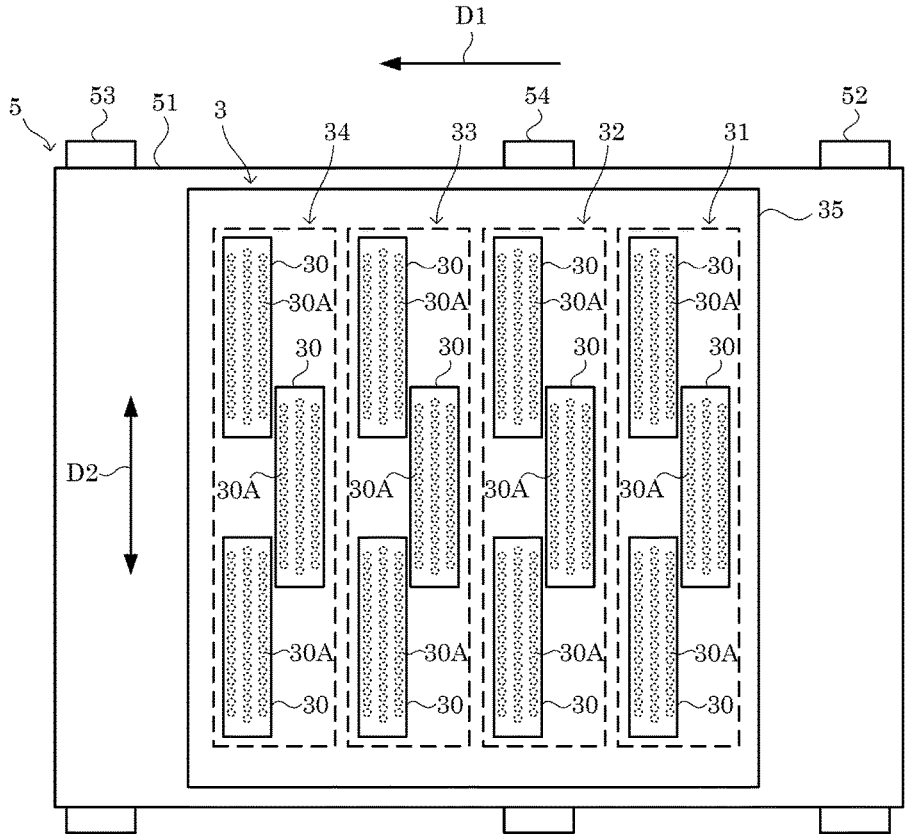
FIG. 2 is a diagram showing a configuration of an image forming portion in the image forming apparatus according to the embodiment of the present disclosure.

First, an outlined configuration of an image forming apparatus 10 according to an embodiment of the present disclosure is described with reference to FIG. 1 to FIG. 3. Here, FIG. 1 is a schematic cross-sectional diagram showing a configuration of the image forming apparatus 10. In addition, FIG. 2 is a plan diagram showing a configuration of an image forming portion 3. It is noted that in FIG. 1, a sheet conveyance path R1 in a housing 11 of the image forming apparatus 10 is indicated by a two-dot chain line. Furthermore, in FIG. 3, flows of electric signals are indicated by arrow lines.

The image forming apparatus 10 is a printer that forms an image by an inkjet system. It is noted that the present disclosure is applicable to image forming apparatuses such as a facsimile apparatus, a copier, and a multifunction peripheral that form an image by the inkjet system.

Figure 3:
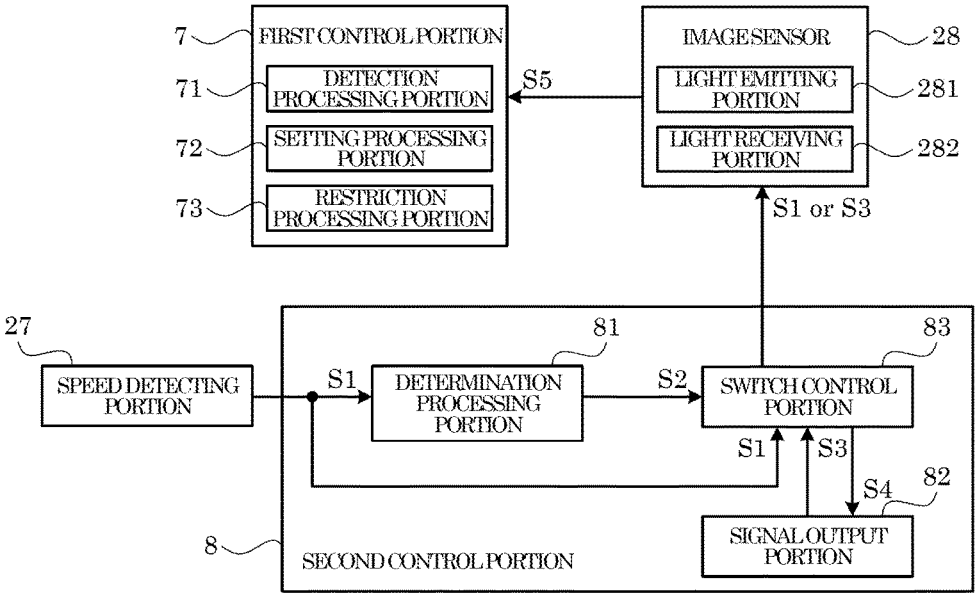
FIG. 3 is a block diagram showing a configuration of a first control portion and a second control portion in the image forming apparatus according to the embodiment of the present disclosure.

As shown in FIGS. 1 and 3, the image forming apparatus 10 includes a sheet feed cassette 1, a sheet feed portion 2, the image forming portion 3, an ink container portion 4, a conveyance unit 5, a sheet discharge portion 6, a first control portion 7, and a second control portion 8. Here, a configuration including the sheet feed cassette 1, the sheet feed portion 2, the conveyance unit 5, the sheet discharge portion 6, the first control portion 7, and the second control portion 8 is an example of the sheet conveyance device of the present disclosure.

The sheet feed cassette 1 stores sheets that are print targets in the image forming apparatus 10. For example, the sheets stored in the sheet feed cassette 1 are sheet-like materials such as sheets of paper, sheets of coated paper, postcards, envelopes, and OHP sheets.

In the image forming apparatus 10, the sheets stored in the sheet feed cassette 1 are conveyed one by one in the interior of the housing 11 along the conveyance path R1 (see FIG. 1) that includes image forming positions P11 to P14 where an image is formed on each sheet by the image forming portion 3, and discharged to a sheet discharge tray 64 of the sheet discharge portion 6.

The sheet feed portion 2 supplies the sheets stored in the sheet feed cassette 1 to the conveyance unit 5 one by one. As shown in FIG. 1 and FIG. 3, the sheet feed portion 2 includes a pickup roller 21, a conveyance roller 22, a conveyance path 23, a manual feed tray 24, a sheet feed roller 25, a registration roller 26, a speed detecting portion 27, and an image sensor 28.

The pickup roller 21 picks up the sheets one by one from the sheet feed cassette 1. The conveyance roller 22 conveys the sheet picked up by the pickup roller 21 to the registration roller 26. The conveyance path 23 is a moving passage of the sheet from the sheet feed cassette 1 and the manual feed tray 24 to the conveyance unit 5. The conveyance path 23 defines a sheet feed path from the sheet feed cassette 1 to the conveyance unit 5, among the conveyance path R1. The manual feed tray 24 and the sheet feed roller 25 are used to supply sheets from outside.

The registration roller 26 is provided on the upstream side of the image forming positions P11 to P14 in the conveyance path R1. Each time a predetermined conveyance timing comes, the registration roller 26 feeds a sheet toward the conveyance unit 5. For example, in the image forming apparatus 10, an optical sensor (not shown) for detecting presence/absence of a sheet is provided on the upstream side of the registration roller 26 in the conveyance path R1. The registration roller 26 is rotationally driven at a timing when a predetermined time period has elapsed since a detection of a front end of a sheet by the optical sensor. The registration roller 26 starts to be decelerated at a timing when a predetermined time period has elapsed since a detection of a rear end of a sheet by the optical sensor, the registration roller 26 being decelerated until it is stopped. The registration roller 26 is rotationally driven by a rotational driving force supplied from a first motor (not shown). Here, the registration roller 26 is an example of the first conveyance member of the present disclosure.

The speed detecting portion 27 detects a rotation speed of the registration roller 26. For example, the speed detecting portion 27 is a rotary encoder attached to a rotation shaft of the registration roller 26. The speed detecting portion 27 outputs an electric signal S1 (see FIG. 3) in a cycle corresponding to a reciprocal of the rotation speed of the registration roller 26. For example, the electric signal S1 is a pulse signal. In the image forming apparatus 10, driving of the first motor is controlled by performing a feedback control based on the electric signal S1 output from the speed detecting portion 27 such that the rotation speed of the registration roller 26 is set to a first speed V1 or a second speed V2 (see FIG. 4) that are described below. In addition, the electric signal S1 output from the speed detecting portion 27 is input to the second control portion 8.

The image sensor 28 is used to detect the shape of the sheet conveyed along the conveyance path R1. For example, the image sensor 28 is an image sensor of a CIS system. As shown in FIG. 1, the image sensor 28 is disposed at a position between the registration roller 26 and the conveyance unit 5 in the conveyance path R1. Specifically, as shown in FIG. 3, the image sensor 28 includes a light emitting portion 281 and a light receiving portion 282.

The light emitting portion 281 emits light toward a detection position P1 (see FIG. 1) located between the registration roller 26 and the image forming positions P11 to P14 in the image forming portion 3 in the conveyance path R1, wherein light beams composing the light are aligned along a width direction D2 (see FIG. 2) of the sheet perpendicular to the conveyance path R1. For example, the light emitting portion 281 is composed of a plurality of light emitting elements, such as LED diodes, arranged along the width direction D2.

The light receiving portion 282 is configured to receive light that has been emitted from the light emitting portion 281 and reflected on the sheet passing the detection position P1, and output a detection signal S5 (see FIG. 3) corresponding to an amount of the received light. For example, the light receiving portion 282 is composed of a plurality of light receiving elements, such as photodiodes, arranged along the width direction D2. The detection signal S5 output from the light receiving portion 282 is input to the first control portion 7.

The image forming portion 3 forms an image based on image data on the sheet supplied from the sheet feed portion 2 by using ink that is developer. As shown in FIG. 1, the image forming portion 3 includes line heads 31, 32, 33, and 34 and a head frame 35 supporting the line heads, the line heads 31, 32, 33, and 34 respectively corresponding to colors black, cyan, magenta, and yellow. The head frame 35 is supported by the housing 11 of the image forming apparatus 10. It is noted that the number of the line heads included in the image forming portion 3 may be 1 (one), or 2 (two) or more excluding 4 (four).

The line heads 31 to 34 are so-called line-head-type recording heads. That is, the image forming apparatus 10 is a so-called line-head-type image forming apparatus. As shown in FIG. 2, the line heads 31 to 34 are elongated in the width direction D2. Specifically, each of the line heads 31 to 34 has a length that corresponds to the width of a sheet of the maximum size among sheets that can be stored in the sheet feed cassette 1. The line heads 31 to 34 are fixed to the head frame 35 at regular intervals along a sheet conveyance direction D1 (see FIG. 2). Positions in the conveyance path R1 respectively facing the line heads 31 to 34 are the image forming positions P11 to P14 in the image forming portion 3.

As shown in FIG. 2, each of the line heads 31 to 34 includes a plurality of recording heads 30. The recording heads 30 eject ink toward a sheet conveyed by the conveyance unit 5. Specifically, a lot of nozzles 30A (see FIG. 2) for ejecting ink are provided on a facing surface of each of the recording heads 30, each of the nozzles 30A having an opening, the facing surface facing the sheet conveyed by the conveyance unit 5. In addition, each of the recording heads 30 includes pressurizing chambers (not shown), piezoelectric elements (not shown), and communication flow passages (not shown), the pressurizing chambers respectively corresponding to the nozzles 30A, the piezoelectric elements 302 respectively corresponding to the pressurizing chambers, the communication flow passages being respectively communicated with the pressurizing chambers. Upon application of a predetermined driving voltage, each of the piezoelectric elements causes ink to be ejected from the nozzle 30A. Specifically, each of the piezoelectric elements pressurizes ink stored in the pressurizing chamber so that the ink is ejected from the nozzle 30A.

In the present embodiment, in the line head 31, three recording heads 30 are arranged in zigzag along the width direction D2. In addition, in each of the other line heads 32 to 34, as in the line head 31, three recording heads 30 are arranged in zigzag along the width direction D2. It is noted that FIG. 2 shows a state where the recording portion 3 is viewed from the upper side of FIG. 1.

The ink container portion 4 includes ink containers 41, 42, 43, and 44 that respectively store black, cyan, magenta, and yellow ink. The ink containers 41 to 44 are connected to the line heads 31 to 34 of the corresponding colors, via ink supply portions (not shown), respectively.

The conveyance unit 5 conveys the sheet on the image forming positions P11 to P14 in the conveyance path R1. Specifically, as shown in FIG. 1, the conveyance unit 5 is disposed below the line heads 31 to 34. The conveyance unit 5 conveys the sheet in a state of facing the recording heads 30. As shown in FIG. 1, the conveyance unit 5 includes a conveyance belt 51 on which the sheet is placed, stretching rollers 52 to 54, and a conveyance frame 55, the sheet conveying belt 51 being stretched over the stretching rollers 52 to 54, the conveyance frame 55 supporting these members. It is noted that the interval between the conveyance belt 51 and the recording heads 30 is adjusted so that during an image forming, the interval between the sheet surface and the recording heads 30 is, for example, 1 (one) mm.

The stretching roller 52 is rotationally driven to rotate at a predetermined second speed V2 (see FIG. 4) by a rotational driving force supplied from a second motor (not shown). This causes the conveyance belt 51 to move, at the second speed V2, in a direction in which the sheet is conveyed in the sheet conveyance direction D1 (see FIG. 1). As a result, the sheet supplied from the sheet feed portion 2 is conveyed by the moving conveyance belt 51 to the sheet discharge portion 6 via the image forming positions P11 to P14 (see FIG. 1). Here, the conveyance belt 51 is an example of the second conveyance member of the present disclosure.

It is noted that the conveyance unit 5 also includes a suction unit (not shown) for sucking air through a lot of through holes formed in the conveyance belt 51 so that the sheet is attracted by the conveyance belt 51. In addition, a pressure roller 56 is provided at a position facing the stretching roller 52 so that the sheet is conveyed while being pressed against the conveyance belt 51.

The sheet discharge portion 6 is provided on the downstream side of the image forming portion 3 in the conveyance direction D1. As shown in FIG. 1, the sheet discharge portion 6 includes a drying device 61, a conveyance path 62, a sheet discharge roller 63, and a sheet discharge tray 64. The drying device 61 dries the ink that has adhered to the sheet, by, for example, blowing air to the sheet. The conveyance path 62 is a moving passage of the sheet from the conveyance unit 5 to the sheet discharge tray 64. The conveyance path 62 defines a sheet discharge path from the conveyance unit 5 to the sheet discharge tray 64, the sheet discharge path being a section of the conveyance path R1. The sheet discharge roller 63 discharges the sheet to the sheet discharge tray 64.

The first control portion 7 comprehensively controls the image forming apparatus 10. Specifically, the first control portion 7 includes control equipment such as CPU, ROM, and RAM that are not shown. The CPU is a processor that executes various calculation processes. The ROM is a non-volatile storage device in which various information such as control programs for causing the CPU to execute various processes are stored in advance. The RAM is a volatile storage device that is used as a temporary storage memory (working area) for the various processes executed by the CPU. In the first control portion 7, the CPU executes the various control programs stored in advance in the ROM. This allows the image forming apparatus 10 to be controlled comprehensively by the first control portion 7. It is noted that the first control portion 7 may be constituted from an electronic circuit such as an integrated circuit (ASIC), and may be a control portion provided independently of a main control portion that comprehensively controls the image forming apparatus 10.

In addition, as shown in FIG. 3, the first control portion 7 includes a detection processing portion 71, a setting processing portion 72, and a restriction processing portion 73. Specifically, the first control portion 7 executes the control programs stored in the ROM by using the CPU. This allows the first control portion 7 to function as the detection processing portion 71, the setting processing portion 72, and the restriction processing portion 73.

The detection processing portion 71 detects the shape of the sheet conveyed toward the image forming portion 3 based on the detection signal S5 output from the image sensor 28. Here, the image sensor 28 and the detection processing portion 71 are an example of the shape detecting portion of the present disclosure.

For example, the detection processing portion 71 detects the shape of the sheet by using a reference value set by the setting processing portion 72. Specifically, the detection processing portion 71 determines whether or not the sheet is present at each of the positions that respectively face the light receiving elements, based on whether or not a value of an amount of received light received by each of the light receiving elements exceeds the reference value. This allows a shape of one line of the sheet to be detected, the one line extending along the width direction D2. It is noted that the detection processing portion 71 may detect the shape of the sheet by using a predetermined value instead of the reference value.

The setting processing portion 72 sets the reference value that is used by the detection processing portion 71 to detect the shape of the sheet, based on the detection signal S5 output from the light receiving portion 282 while the registration roller 26 is in a stopped state.

For example, each time the registration roller 26 changes its state from a driven state to the stopped state, the setting processing portion 72 sets the reference value based on the detection signal S5 output from the light receiving portion 282. In addition, the setting processing portion 72 sets the reference value for each of the light receiving elements. For example, the setting processing portion 72 sets, as the reference value for each of the light receiving elements, a sum of a predetermined value and an amount of light received by each of the light receiving elements included in the detection signal S5.

The restriction processing portion 73 restricts the image forming portion 3 from forming an image beyond the sheet, based on the shape of the sheet detected by the detection processing portion 71.

For example, the restriction processing portion 73 changes data corresponding to a region outside a sheet in image data input to the image forming portion 3, to data whose color components of cyan, magenta, and yellow are zero (data corresponding to white). This prevents ink ejected from the recording heads 30 from adhering to the conveyance belt 51 in a case where the sheet has become oblique with respect to the conveyance path R1, in a case where the sheet has a defect such as a punched hole, or in other cases. As a result, a cleaning mechanism for cleaning ink adhered to the conveyance belt 51 is not necessary.

It is noted that the image forming portion 3 may form an image by an electrophotographic system. In that case, the image forming apparatus 10 can prevent toner from adhering to the conveyance belt 51, the toner being the developer. Here, it is easier to clean the conveyance belt 51 when the developer that adheres to the conveyance belt 51 is toner, than when the developer is ink. As a result, the present disclosure is suitable for an image forming apparatus of the inkjet system.

Figure 4:
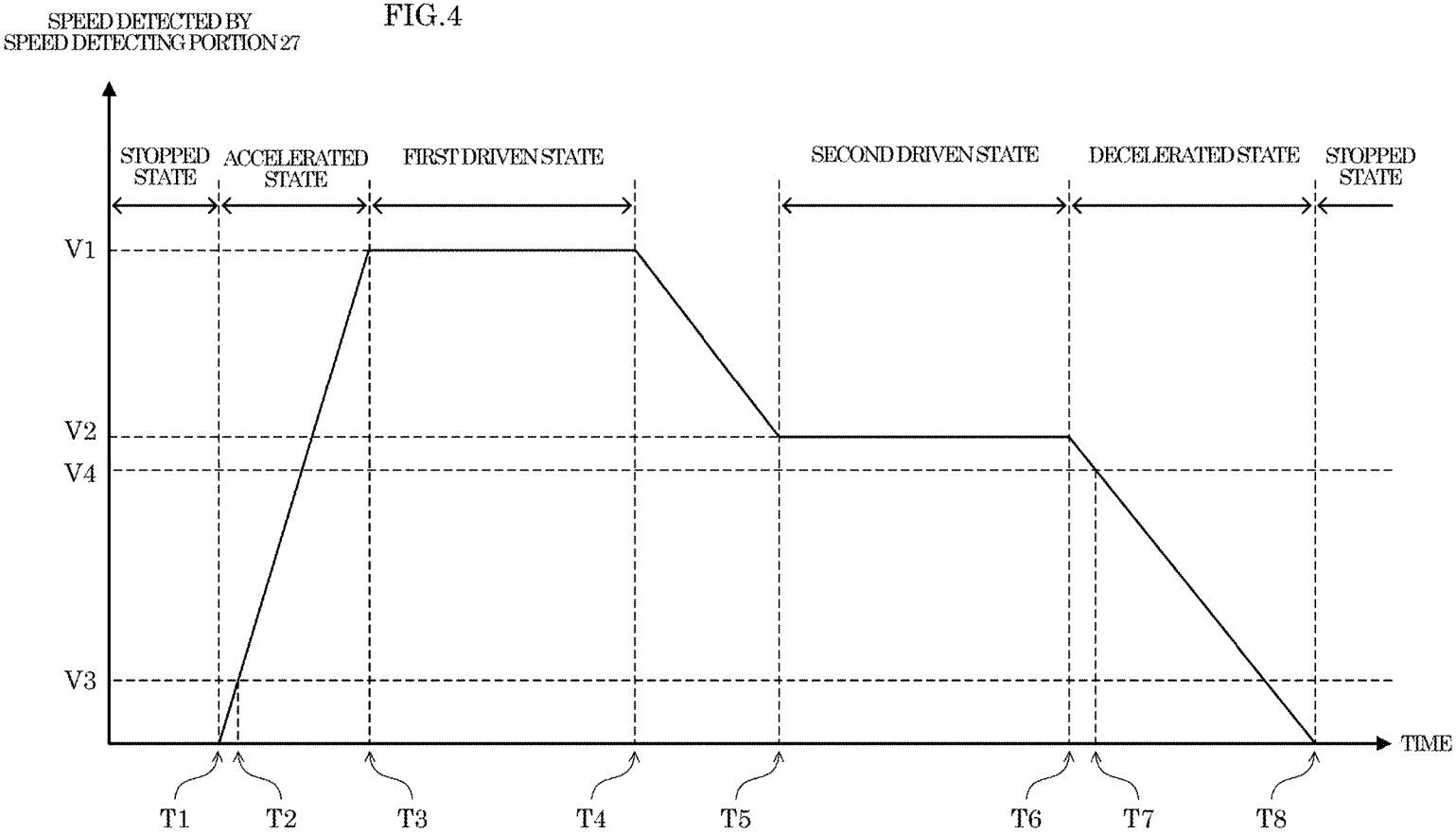
FIG. 4 is a diagram showing a driving cycle of a registration roller in the image forming apparatus according to the embodiment of the present disclosure.

Meanwhile, as shown in FIG. 4, in the image forming apparatus 10, the registration roller 26 is rotationally driven in a driving cycle in which the registration roller 26 enters a driven state where the registration roller 26 is driven while decelerated in a stepped manner, and then the registration roller 26 is decelerated to a stopped state. Specifically, the registration roller 26 is accelerated from the stopped state to the first speed V1 that is higher than the second speed V2, and transits to a first driven state where it is driven at the first speed V1. Subsequently, the registration roller 26 is decelerated from the first driven state to the second speed V2, and transits to a second driven state where it is driven at the second speed V2. The registration roller 26 is then decelerated from the second driven state to the stopped state. This makes it possible to reduce an interval to a conveyed preceding sheet. It is noted that the number of steps of the driving speed of the registration roller 26 may be three or more.

Here, in the image forming apparatus 10, the image sensor 28 is disposed between the registration roller 26 and the conveyance belt 51. In this case, the sheet conveyance speed changes while the image sensor 28 is detecting the shape of the sheet. As a result, in a case where the output interval at which the detection signal S5 corresponding to the shape of the sheet is output from the image sensor 28 is set to a fixed interval, the positions on the sheet at which the shape of the sheet is detected by the detection processing portion 71 become irregular, and the accuracy of the sheet shape detection is reduced.

One of assumed countermeasures for the problem would be to synchronize the output interval at which the detection signal S5 is output from the image sensor 28, with the rotation speed of the registration roller 26. However, in that case, while the registration roller 26 is stopped, the detection signal S5 is not output from the image sensor 28. When this happens, until the next sheet is conveyed, the setting processing portion 72 cannot set the reference value based on the detection signal S5 output from the image sensor 28.

On the other hand, the image forming apparatus 10 according to the embodiment of the present disclosure is configured to restrict reduction in accuracy of detecting the shape of the sheet, and set, before the next sheet is conveyed, the reference value used to detect the shape of the sheet.

In the following, the second control portion 8 is described with reference to FIG. 3 and FIG. 4.

The second control portion 8 is configured to switch the output interval at which the detection signal S5 is output from the light receiving portion 282 of the image sensor 28, between a first interval corresponding to the speed detected by the speed detecting portion 27 and a predetermined second interval. For example, the second control portion 8 is composed of an electronic circuit such as an integrated circuit (ASIC, DSP). It is noted that in the image forming apparatus 10, the CPU of the first control portion 7 may function as the second control portion 8 by executing the control program stored in the ROM.

Specifically, as shown in FIG. 3, the second control portion 8 includes a determination processing portion 81, a signal output portion 82, and a switch control portion 83.

The determination processing portion 81 determines whether the registration roller 26 is in an accelerated state or in a decelerated state, wherein in the accelerated state, the registration roller 26 is accelerated from the stopped state to the first driven state, and in the decelerated state, the registration roller 26 is decelerated from the second driven state to the stopped state.

For example, the determination processing portion 81 determines whether the registration roller 26 is in the accelerated state or in the decelerated state, based on the detected speed thereof indicated by the input cycle of the electric signal S1 input from the speed detecting portion 27.

For example, the determination processing portion 81 determines that the registration roller 26 is in the accelerated state when the detected speed exceeds a third speed V3 (see FIG. 4) that is lower than the second speed V2. In addition, the determination processing portion 81 determines that the registration roller 26 is in the decelerated state when the detected speed is lower than a fourth speed V4 (see FIG. 4) that is lower than the second speed V2 and higher than the third speed V3. Specifically, the third speed V3 is set to a speed that is lower than a speed at which the registration roller 26 is driven at a timing when a forward end of the sheet reaches the detection position P1.

With this configuration, it is possible to advance both timings for detecting the accelerated state and the decelerated state, compared to a configuration where it is determined whether the registration roller 26 is in the accelerated state or in the decelerated state by using only one threshold that is equal to or higher than the third speed V3 and equal to or lower than the fourth speed V4. In addition, it is possible to restrict an erroneous determination from being made due to noise mixed to the electric signal S1, compared to a configuration where it is determined whether the registration roller 26 is in the accelerated state or in the decelerated state by using only the above-mentioned threshold.

It is noted that the determination processing portion 81 may determine whether the registration roller 26 is in the accelerated state or in the decelerated state by using only the above-mentioned threshold. In addition, the determination processing portion 81 may determine whether the registration roller 26 is in the accelerated state or in the decelerated state, based on a time period that has elapsed since a detection of a front end or a rear end of a sheet by the optical sensor.

The determination processing portion 81 outputs an electric signal S2 (see FIG. 3) that indicates a determination result. The electric signal S2 output from the determination processing portion 81 is input to the switch control portion 83.

The signal output portion 82 outputs an electric signal S3 (see FIG. 3) each time a time period corresponding to the second interval elapses. For example, the electric signal S3 is a pulse signal as is the case with the electric signal S1. The electric signal S3 output from the signal output portion 82 is input to the switch control portion 83.

Here, in the image forming apparatus 10, the registration roller 26 transits from the second driven state to the decelerated state before the rear end of the sheet passes the detection position P1. In this case, during a period after the rear end of the sheet passes the registration roller 26 until it passes the detection position P1, the sheet is conveyed at the second speed V2 at which the conveyance belt 51 is driven.

Here, in the image forming apparatus 10, the second interval is set in accordance with the second speed V2. With this configuration, it is possible to restrict reduction in the accuracy of detecting, by the detection processing portion 71, the shape of the sheet during the period after the rear end of the sheet passes the registration roller 26 until it passes the detection position P1. It is noted that in the image forming apparatus 10, in a case where the registration roller 26 transits from the second driven state to the decelerated state after the rear end of the sheet passes the detection position P1, the second interval may not be set in accordance with the second speed V2.

When the determination processing portion 81 determines that the registration roller 26 is in the accelerated state, the switch control portion 83 switches the output interval at which the detection signal S5 is output from the light receiving portion 282, to the first interval; and when the determination processing portion 81 determines that the registration roller 26 is in the decelerated state, the switch control portion 83 switches the output interval to the second interval.

Specifically, in the image forming apparatus 10, the light receiving portion 282 outputs the detection signal S5 in response to an input of a specific electric signal (an example of the predetermined electric signal of the present disclosure) which is the electric signal S1, the electric signal S3 or the like. In addition, when the determination processing portion 81 determines that the registration roller 26 is in the accelerated state, the switch control portion 83 switches an output source of the specific electric signal that is input to the light receiving portion 282, from the signal output portion 82 to the speed detecting portion 27. Furthermore, when the determination processing portion 81 determines that the registration roller 26 is in the decelerated state, the switch control portion 83 switches the output source of the specific electric signal that is input to the light receiving portion 282, from the speed detecting portion 27 to the signal output portion 82.

For example, when the determination processing portion 81 determines that the registration roller 26 is in the accelerated state, the switch control portion 83 switches the output source of the specific electric signal to the speed detecting portion 27, and restricts the electric signal S1 that is output from the speed detecting portion 27 for the first time after the switch, from being input to the light receiving portion 282.

In addition, after the determination processing portion 81 determines that the registration roller 26 is in the decelerated state, the switch control portion 83 switches the output source of the specific electric signal to the signal output portion 82 simultaneously when the electric signal S1 that is output from the speed detecting portion 27 for the first time after the determination is input to the light receiving portion 282, and resets the time measured by the signal output portion 82. Specifically, the switch control portion 83 resets the time measured by the signal output portion 82, by inputting a reset signal S4 (see FIG. 3) to the signal output portion 82.

It is noted that the second control portion 8 may not include the signal output portion 82. For example, a rotary encoder may be attached to a rotation shaft of the stretching roller 52 that rotates the conveyance belt 51, and an electric signal output from the rotary encoder may be input to the switch control portion 83.

Next, an operation of the second control portion 8 is described with reference to FIG. 4.

First, at time T1, a rotational driving of the registration roller 26 is started, and the registration roller 26 transits from the stopped state to the accelerated state. This allows the speed detecting portion 27 to output the electric signal S1 in a cycle corresponding to a reciprocal of the detected speed.

Subsequently, at time T2, the rotation speed of the registration roller 26 exceeds the third speed V3. The determination processing portion 81 determines that the registration roller 26 is in the accelerated state based on the detected speed indicated by the input cycle of the electric signal S1 input from the speed detecting portion 27, and outputs the electric signal S2 that indicates the determination result. Upon receiving the electric signal S2 indicating that the registration roller 26 is in the accelerated state, the switch control portion 83 switches the output source of the specific electric signal that is input to the light receiving portion 282, from the signal output portion 82 to the speed detecting portion 27. This allows the output interval at which the detection signal S5 is output from the image sensor 28, to be switched to the first interval that is synchronized with the rotation speed of the registration roller 26. With this configuration, if the sheet conveyance speed of the registration roller 26 changes while the sheet is passing the detection position P1, it is possible to restrict reduction in the accuracy of detecting the shape of the sheet.

Here, the switch control portion 83 switches the output source of the specific electric signal to the speed detecting portion 27, and restricts the electric signal S1 that is output from the speed detecting portion 27 for the first time after the switching, from being input to the light receiving portion 282. This prevents the input interval between: the electric signal S3 that has been input from the signal output portion 82 to the light receiving portion 282 before the switching; and the electric signal S1 that is input from the speed detecting portion 27 to the light receiving portion 282 after the switching, from becoming extremely short. Accordingly, it is possible to avoid an operation defect that would occur if the input interval in the image sensor 28 was extremely short.

It is noted that the third speed V3 is preferably set so that the front end of the sheet reaches the detection position P1 after a timing comes at which the electric signal S1 that is output from the speed detecting portion 27 for the second time after the switching performed by the switch control portion 83, is input to the light receiving portion 282.

Subsequently, at time T3, the rotation speed of the registration roller 26 reaches the first speed V1, and the registration roller 26 transits from the accelerated state to the first driven state.

Subsequently, at times T4 to T5, the rotation speed of the registration roller 26 is decelerated from the first speed V1 to the second speed V2, and the registration roller 26 transits from the first driven state to the second driven state.

Subsequently, at time T6, the rotation speed of the registration roller 26 is decelerated from the second speed V2, and the registration roller 26 transits from the second driven state to the decelerated state.

Subsequently, at time T7, the rotation speed of the registration roller 26 becomes lower than the fourth speed V4. The determination processing portion 81 determines that the registration roller 26 is in the decelerated state based on the detected speed indicated by the input cycle of the electric signal S1 input from the speed detecting portion 27, and outputs the electric signal S2 that indicates the determination result. Upon receiving the electric signal S2 indicating that the registration roller 26 is in the decelerated state, the switch control portion 83 switches the output source of the specific electric signal that is input to the light receiving portion 282, from the speed detecting portion 27 to the signal output portion 82. This allows the output interval at which the detection signal S5 is output from the image sensor 28, to be switched to the second interval. With this configuration, it is possible to allow the image sensor 28 to output the detection signal S5 even after the registration roller 26 is stopped.

Here, the switch control portion 83 switches the output source of the specific electric signal to the signal output portion 82 simultaneously when the electric signal S1 that is output from the speed detecting portion 27 for the first time after the determination made by the determination processing portion 81 is input to the light receiving portion 282, and resets the time measured by the signal output portion 82. With this configuration where the time measured by the signal output portion 82 is reset at the timing when the output source of the specific electric signal is switched, the input interval between: the electric signal S1 that is input to the light receiving portion 282 before the switching; and the electric signal S3 that is input to the light receiving portion 282 after the switching, is prevented from becoming extremely short. Accordingly, it is possible to avoid an operation defect that would occur if the input interval in the image sensor 28 was extremely short. In addition, with this configuration where the output source of the specific electric signal is switched simultaneously when the electric signal S1 that is output from the speed detecting portion 27 for the first time after the determination made by the determination processing portion 81 is input to the light receiving portion 282, and the time measured by the signal output portion 82 is reset, the input interval is prevented from being lengthened, compared to the input intervals before and after thereof.

At time T8, the rotational driving of the registration roller 26 is stopped, and the registration roller 26 transits from the decelerated state to the stopped state. This stops the output of the electric signal S1 from the speed detecting portion 27.

As described above, in the image forming apparatus 10, when it is determined that the registration roller 26 is in the accelerated state, the output interval at which the detection signal S5 is output from the image sensor 28 is switched to the first interval that corresponds to the speed detected by the speed detecting portion 27. In addition, when it is determined that the registration roller 26 is in the decelerated state, the output interval is switched to the second interval. This makes it possible to restrict reduction in the accuracy of detecting the shape of the sheet, and set, before the next sheet is conveyed, the reference value used to detect the shape of the sheet.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet conveyance device comprising:

a first conveyance member provided on an upstream side of an image forming position in a conveyance path along which a sheet is conveyed, the first conveyance member being rotationally driven in a driving cycle in which the first conveyance member enters a driven state where the first conveyance member is driven while decelerated in a stepped manner, and then the first conveyance member is decelerated to a stopped state;

a shape detecting portion including a light emitting portion and a light receiving portion, the light emitting portion being configured to emit light toward a detection position located between the first conveyance member and the image forming position in the conveyance path, the light extending in a width direction of the sheet perpendicular to the conveyance path, the light receiving portion being configured to receive the light that has been emitted from the light emitting portion and reflected on the sheet passing the detection position, and output a detection signal corresponding to an amount of received light, the shape detecting portion being configured to detect a shape of the sheet based on the detection signal;

a speed detecting portion configured to detect a rotation speed of the first conveyance member;

a determination processing portion configured to determine whether the first conveyance member is in an accelerated state or in a decelerated state, wherein in the accelerated state, the first conveyance member is accelerated from the stopped state to the driven state, and in the decelerated state, the first conveyance member is decelerated from the driven state to the stopped state; and a switch control portion configured to, when the determination processing portion determines that the first conveyance member is in the accelerated state, switch an output interval at which the detection signal is output from the light receiving portion, to a first interval that corresponds to the rotation speed detected by the speed detecting portion, and when the determination processing portion determines that the first conveyance member is in the decelerated state, switch the output interval to a predetermined second interval.

2. The sheet conveyance device according to claim 1, wherein the determination processing portion determines whether the first conveyance member is in the accelerated state or in the decelerated state, based on the rotation speed detected by the speed detecting portion.

3. The sheet conveyance device according to claim 2, further comprising:

a second conveyance member configured to be rotationally driven at a predetermined second speed at the image forming position so as to convey the sheet, wherein the first conveyance member transits from a first driven state to a second driven state, and then transits from the second driven state to the decelerated state before a rear end of the sheet passes the detection position, wherein in the first driven state, the first conveyance member is driven at a first speed that is higher than the second speed, and in the second driven state, the first conveyance member is driven at the second speed, and the second interval is set in accordance with the second speed.

4. The sheet conveyance device according to claim 3, wherein the determination processing portion determines that the first conveyance member is in the accelerated state when the rotation speed detected by the speed detecting portion exceeds a third speed that is lower than the second speed, and the determination processing portion determines that the first conveyance member is in the decelerated state when the rotation speed detected by the speed detecting portion is lower than a fourth speed that is lower than the second speed and higher than the third speed.

5. The sheet conveyance device according to claim 4, wherein the light receiving portion outputs the detection signal in response to an input of a predetermined electric signal, the speed detecting portion outputs the electric signal in a cycle corresponding to a reciprocal of a rotation speed of the first conveyance member, the sheet conveyance device further comprises:

a signal output portion configured to output the electric signal each time a time period corresponding to the second interval elapses, and when the determination processing portion determines that the first conveyance member is in the accelerated state, the switch control portion switches an output source of the electric signal that is input to the light receiving portion, to the speed detecting portion, and when the determination processing portion determines that the first conveyance member is in the decelerated state, the switch control portion switches the output source of the electric signal to the signal output portion.

6. The sheet conveyance device according to claim 5, wherein after the determination processing portion determines that the first conveyance member is in the decelerated state, the switch control portion switches the output source of the electric signal to the signal output portion simultaneously when the electric signal that is output from the speed detecting portion for a first time after the determination processing portion determines that the first conveyance member is in the decelerated state is input to the light receiving portion, and resets a time measured by the signal output portion.

7. The sheet conveyance device according to claim 5, wherein when the determination processing portion determines that the first conveyance member is in the accelerated state, the switch control portion switches the output source of the electric signal to the speed detecting portion, and restricts the electric signal that is output from the speed detecting portion for a first time after the switch control portion switches the output source to the speed detecting portion, from being input to the light receiving portion.

8. The sheet conveyance device according to claim 1, further comprising:

a setting processing portion configured to set a reference value that is used by the shape detecting portion to detect the shape of the sheet, based on the detection signal output from the light receiving portion while the first conveyance member is in the stopped state, wherein the shape detecting portion detects the shape of the sheet by using the reference value set by the setting processing portion.

9. An image forming apparatus comprising:

the sheet conveyance device according to claim 1; and an image forming portion configured to form an image on a sheet at the image forming position.

10. The image forming apparatus according to claim 9, further comprising:

a restriction processing portion configured to restrict the image forming portion from forming an image beyond the sheet, based on the shape of the sheet detected by the shape detecting portion.

11. The image forming apparatus according to claim 9, wherein the image forming portion forms the image on the sheet by an inkjet system.

12. A sheet shape detecting method executed on a sheet conveyance device which includes a first conveyance member, a shape detecting portion, and a speed detecting portion, the first conveyance member being provided on an upstream side of an image forming position included in a conveyance path along which a sheet is conveyed, the first conveyance member being rotationally driven in a driving cycle in which the first conveyance member enters a driven state where the first conveyance member is driven while decelerated in a stepped manner, and then the first conveyance member is decelerated to a stopped state, the shape detecting portion including a light emitting portion and a light receiving portion, the light emitting portion being configured to emit light toward a detection position located between the first conveyance member and the image forming position in the conveyance path, the light extending in a width direction of the sheet perpendicular to the conveyance path, the light receiving portion being configured to receive light that has been emitted from the light emitting portion and reflected on the sheet passing the detection position, and output a detection signal corresponding to an amount of received light, the shape detecting portion detecting a shape of the sheet based on the detection signal, the speed detecting portion being configured to detect a rotation speed of the first conveyance member, the sheet shape detecting method comprising:

determining whether the first conveyance member is in an accelerated state or in a decelerated state, wherein in the accelerated state, the first conveyance member is accelerated from the stopped state to the driven state, and in the decelerated state, the first conveyance member is decelerated from the driven state to the stopped state; and when it is determined that the first conveyance member is in the accelerated state, switching an output interval at which the detection signal is output from the light receiving portion, to a first interval that corresponds to the rotation speed detected by the speed detecting portion, and when it is determined that the first conveyance member is in the decelerated state, switching the output interval to a predetermined second interval.

* * * * *